US006244590B1

(12) United States Patent
Williams

(10) Patent No.: US 6,244,590 B1
(45) Date of Patent: Jun. 12, 2001

(54) COLLATING DEVICE

(75) Inventor: Christopher Hugh Williams, Essex (GB)

(73) Assignee: Printed Products Equipment, Ltd., Loughton (GB)

( * ) Notice: Subject to any disclaimer, the term of this patent is extended or adjusted under 35 U.S.C. 154(b) by 0 days.

(21) Appl. No.: 09/266,298

(22) Filed: Mar. 11, 1999

(30) Foreign Application Priority Data

Mar. 17, 1998 (GB) ..... 9805730

(51) Int. Cl.[7] ..... B65H 29/00

(52) U.S. Cl. ..... 271/184; 271/186; 271/207; 271/220; 271/902; 270/58.01; 270/59; 414/789; 414/789.9; 414/790.3

(58) Field of Search ..... 414/789, 789.9, 414/790.3, 790.8; 270/58.01, 59, 58.07, 58.08, 58.11; 271/184, 185, 186, 207, 220, 902

(56) References Cited

U.S. PATENT DOCUMENTS

| | | | | |
|---|---|---|---|---|
| 4,078,789 | * | 3/1978 | Kittredge et al. | 271/186 X |
| 4,159,824 | * | 7/1979 | Stange et al. | 271/184 |
| 4,673,176 | * | 6/1987 | Schenk | 271/186 |
| 4,802,665 | | 2/1989 | Allio et al. | 271/225 |
| 5,514,066 | | 5/1996 | Monaco | 493/25 |
| 5,720,478 | * | 2/1998 | Carter et al. | 271/902 |
| 5,906,367 | * | 5/1999 | Takagaki | 271/218 |

FOREIGN PATENT DOCUMENTS

| | | | |
|---|---|---|---|
| 255684 | | 2/1988 | (EP) . |
| 842423 | | 1/1939 | (FR) . |
| 52-097744 | * | 8/1977 | (JP) . |
| WO 95/22462 | | 8/1995 | (WO) . |

* cited by examiner

*Primary Examiner*—Christopher P. Ellis
*Assistant Examiner*—Patrick Mackey
(74) *Attorney, Agent, or Firm*—Fitch, Even, Tabin & Flannery

(57) ABSTRACT

A collating device for sheet material comprises a collating station (1) having a pair of guide members (8, 10) for receiving sheets to be collated through an opening (9) therebetween, first conveyor means (3) for conveying sheets consecutively into the collating station and second conveyor means (5) for conveying a collated stack of sheets out of the collating station, support means (12) biased towards a position for supporting sheets in the collating station away from the second conveyor means, and an actuator member (14) movable to urge a collated stack of sheets towards the second conveyor means against the bias of the support means.

9 Claims, 2 Drawing Sheets

COLLATING DEVICE

BACKGROUND OF THE INVENTION

The present invention relates to a collating device, for example for use in mailing machines which collate sheet material for mailing, fold the collated material and insert it into envelopes.

A known collating device is shown in FIGS. 1 and 2. The device 20 comprises conveyor rollers 21 on a shaft 22, the rollers engaging further conveyor rollers 24 on a shaft 25. As shown in FIG. 2, sheets extracted from a feeding station are fed into the collator device between the rollers 21 & 24 by a rotary drive applied to the shaft 22. The sheets emerge from between the rollers 21 & 24 to enter between a base or lower support plate 27 and an upper or guide plate 29. The path followed by each sheet is curved, as indicated by arrow 30, but once the sheet has fully entered between the plates 27 & 29, it will lie flat so that the next sheet fed in will overlie it.

The shaft 25 mounts not only the rollers 24 but also rollers 31 engaged with rollers 32 on a third shaft 34. The shaft 25 is stationary, and the rollers 24 and 31 are free-running thereon. Thus, rotation of the shaft 34 may effect discharge of a set of sheets accumulated in the collator device.

The discharge of an accumulated stack of sheets from the collator device can be assisted by the inclination of the base plate 27 as shown. Additionally or instead, the sheets can be fed in against a stop member 36 at the inner end of the device, the stop member being biased by a spring 37. Alternatively, the discharge can be assisted by a solenoid operated pusher located at the position of the stop member 36, the pusher being actuated at the beginning of each discharge operation.

This type of collating device requires the various rollers to be driven selectively in order alternately to feed sheets into the device, and to discharge the collated sheets. The present invention aims to provide a more simple device which is easier to operate.

BRIEF SUMMARY OF THE INVENTION

According to the present invention, there is provided a collating device for sheet material comprising a collating station having a pair of guide members for receiving sheets to be collated through an opening therebetween, first conveyor means for conveying sheets consecutively into the collating station and second conveyor means for conveying a collated stack of sheets out of the collating station, support means biased towards a position for supporting sheets in the collating station away from the second conveyor means, and an actuator member movable to urge a collated stack of sheets towards the second conveyor means against the bias of the support means.

Preferably, the support means is a flexible member mounted adjacent the opening between the guide members, and the actuator member is mounted across the guide members to form a closed end of the collating station.

The first conveyor means may be a nip between a first and a second roller or set of rollers, and the second conveyor means may be a nip between the second and a third roller or set of rollers. Thus, the flexible member may be arranged to support sheets in the collating station in a position between the first and second nips resting against the second roller(s). The actuator member may then be movable towards the opening between the guide members so as to urge the sheets against the second roller(s). The sheets may thus frictionally engage the second roller(s) and be conveyed into the second nip.

Thus, in accordance with this invention, the rollers may be continuously operated during the collating and discharge processes.

BRIEF DESCRIPTION OF THE DRAWINGS

In order that the invention may be more readily understood, reference will now be made, by way of example, to the accompanying drawings, in which.

DETAILED DESCRIPTION

Figure 1:
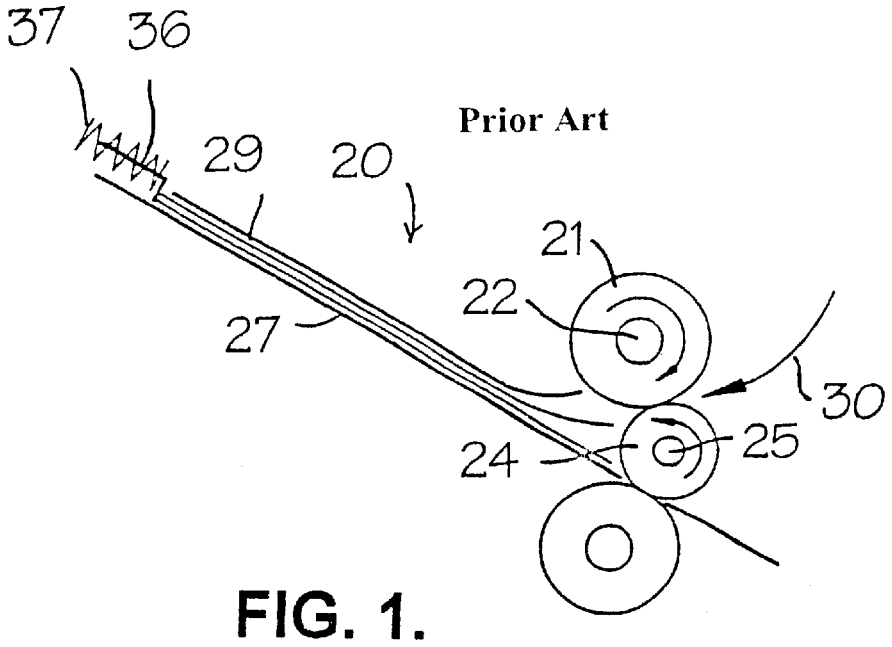
Prior Art FIG. 1.
FIG. 1 is a schematic cross-sectional side view of a collating device according to the prior art.
Figure 2:
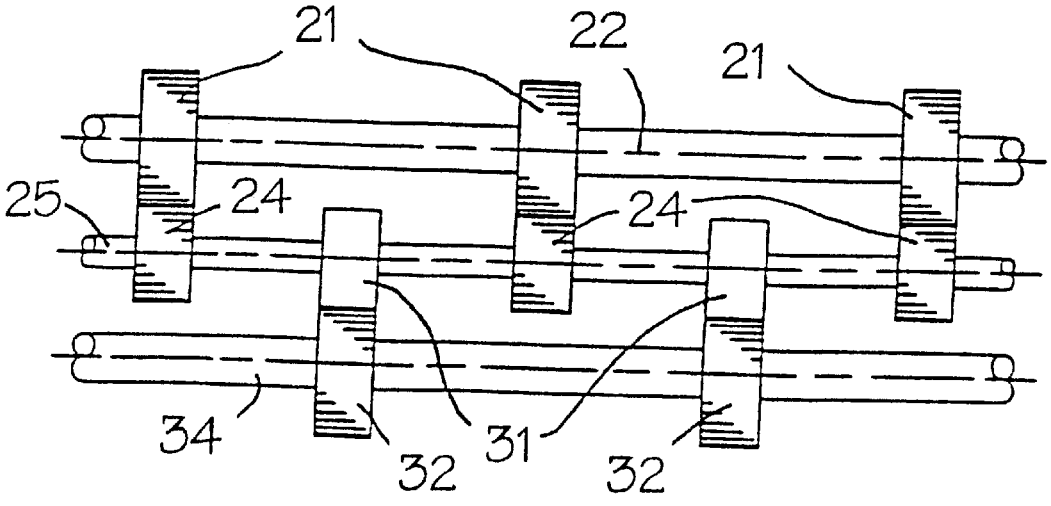
Prior Art FIG. 2.
FIG. 2 is a schematic plan view of part of the device shown in FIG. 1.
Figure 3:
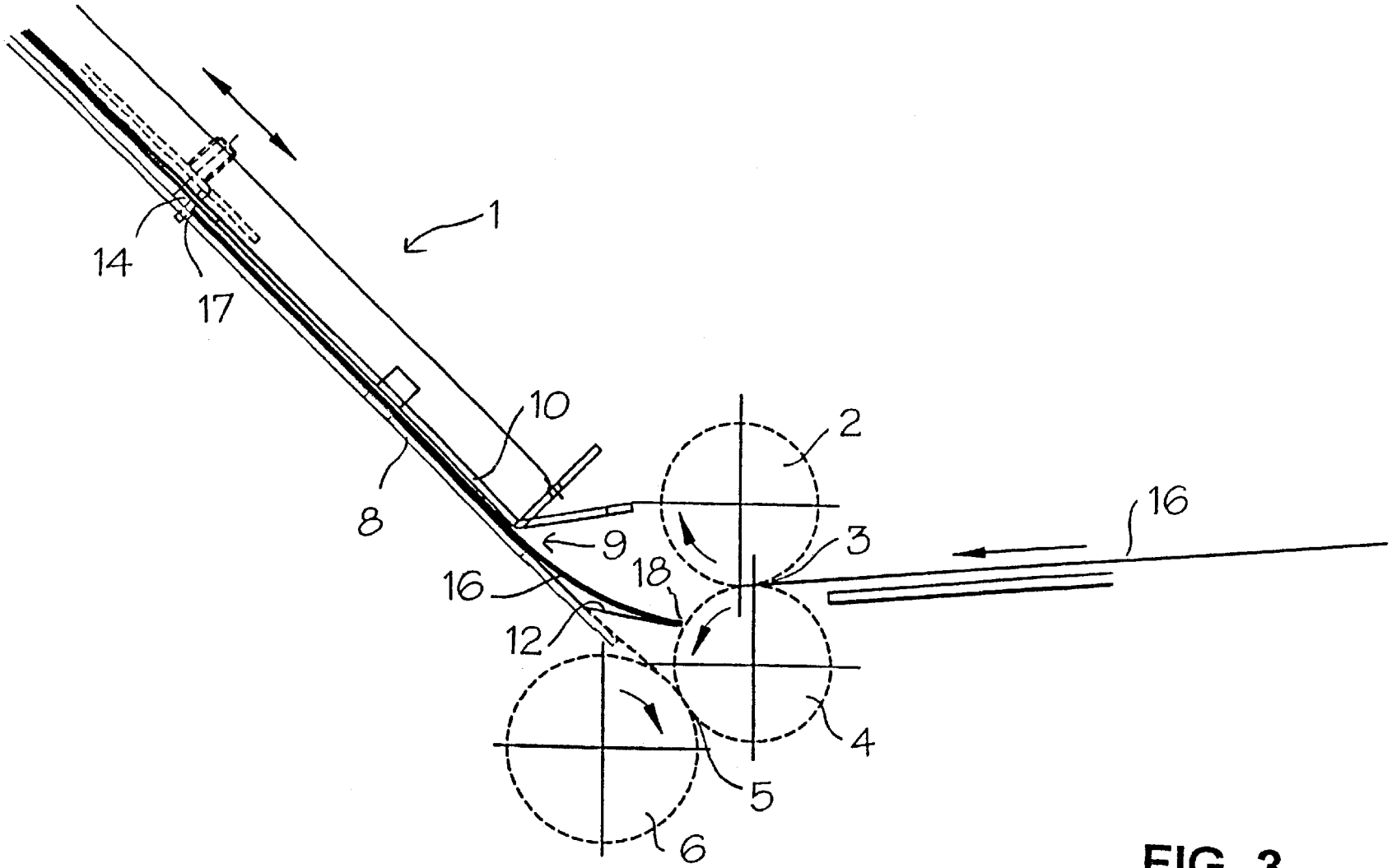
FIG. 3 is a schematic cross-sectional side view of a collating device according to the present invention.

Referring to FIG. 3, the collating device includes a first and a second roller or set of rollers 2,4 which cooperate to form a first nip 3 for conveying sheets towards a collating station 1. The second roller 4 further cooperates with a third roller or set of rollers 6 to form a second nip 5 for conveying a collated stack out of the collating station 1. The collating station 1 comprises a lower support plate 8 and an upper guide plate 10. A flexible lip 12 extends from the support plate 8 to a position adjacent the second roller 4 between the first and second nips 3,5. An actuator 14 is mounted across the plates 8, 10 forming a closed end of the collating station 1, and is moveable towards or away from an opening 9 between the plates 8, 10.

In use, the rollers 2,4,6 are driven in the directions shown by the arrows such that a sheet 16 entering the first nip 3 is conveyed into the collating station 1 between the plates 8, 10. When a sheet 16 has entered the collating station 1 and the trailing edge 18 of the sheet 16 leaves the nip 3 it drops down and comes to rest supported on the flexible lip 12, and resting against the rotating edge of the second roller 4.

The actuator 14 may be positioned such that in this position the leading edge 17 of a sheet 16 in the collating station 1 abuts the actuator 14. Alternatively, the actuator 14 may be positioned further away from the opening. Further sheets may be fed into the collating station to overlie each other.

When the required number of sheets have been collated, the actuator 14 is moved towards the opening 9. This action causes the previously trailing edges 18 of the sheets 16 to engage frictionally with the surface of the second roller 4. Thus the trailing edges 18 move around with the roller 4 towards the second nip 5, overcoming the bias of the flexible lip 12, which flexes away towards the support plate 8. The collated stack of sheets 16 then enters the second nip 5 and is conveyed out of the collating station 1.

What is claimed is:

1. A collating device for sheet material comprising a collating station hating a pair of guide members for receiving sheets to be collated through an opening therebetween, first conveyor means for conveying sheets consecutively into the collating station and second conveyor means for conveying a collated stack of sheets out of the collating station, support means comprising a flexible member biased towards a position for supporting sheets in the collating station away from the second conveyor means in a position between the member movable to urge a collated stack of sheets towards the second conveyor means against and to overcome the bias of the support means.

2. A collating device as claimed in claim 1 wherein the flexible member it mounted adjacent the opening between the guide members.

3. A collating device as claimed in claim 1, wherein the actuator member is mounted across the guide members to form a closed end of the collating station.

4. A collating device as claimed in claim 1, wherein the first conveyor means is a nip between a first and a second roller and the second conveyor means is a nip between the second and a third roller.

5. A collating device as claimed in claim 4, wherein the support means is arranged to support sheets in the collating station in a position resting against the second roller.

6. A collating device as claimed in claim 4, wherein the actuator member is movable towards the opening between the guide members so as to urge a collated stack of sheets against the second roller.

7. A collating device for sheet material comprising a collating station having a pair of guide members for receiving sheets to be collated through an opening therebetween, first conveyor means for conveying sheets consecutively into the collating station and second conveyor means for conveying a collated stack of sheets out of the collating station, support means comprising a flexible member biased towards a position for supporting sheets in the collating station away from the second conveyor means, and an actuator member movable to urge a collated stack of sheets towards the second conveyor means against the bias of the support means, wherein the first conveyor means is a nip between a first and a second roller and the second conveyor means is a nip between the second and a third roller, and the support means is arranged to support sheets in a position resting against the second roller.

8. A collating device for sheet material comprising a collating station having a pair of guide members for receiving sheets to be collated through an opening therebetween, first conveyor means for conveying sheets consecutively into the collating station and second conveyor means for conveying a collated stack of sheets out of the collating station, support means comprising a flexible member biased towards a position for supporting sheets in the collating station away from the second conveyor means, and an actuator member movable to urge a collated stack of sheets towards the second conveyor means against the bias of the support means, wherein the flexible member is mounted adjacent the opening between the guide members.

9. A collating device for sheet material comprising a collating station having a pair of guide members for receiving sheets to be collated through an opening therebetween, first conveyor means for conveying sheets consecutively into the collating station and second conveyor means for conveying a collated stack of sheets out of the collating station, support means comprising a flexible member biased towards a position for supporting sheets in the collating station, away from the second conveyor, means, and an actuator member movable, to urge a collated stack of sheets towards the second conveyor means against the bias of the support means, wherein the actuator member is mounted across the guide members to form a closed end of the collating station.

* * * * *

UNITED STATES PATENT AND TRADEMARK OFFICE

CERTIFICATE OF CORRECTION

PATENT NO. : 6,244,590 B1
DATED : June 12, 2001
INVENTOR(S) : Williams

It is certified that error appears in the above-identified patent and that said Letters Patent is hereby corrected as shown below:

Column 2,
Line 54, delete the word “hating” and insert the word -- having --.

Signed and Sealed this

Tenth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,244,590 B1
DATED : June 12, 2001
INVENTOR(S) : Williams

It is certified that error appears in the above-identified patent and that said Letters Patent is hereby corrected as shown below:

Title page,
Item [73], Assignee, delete the word "Products" and insert The word -- Forms --.

Signed and Sealed this

Seventeenth Day of December, 2002

JAMES E. ROGAN
*Director of the United States Patent and Trademark Office*